US006877628B2

(12) United States Patent
Nesting

(10) Patent No.: US 6,877,628 B2
(45) Date of Patent: Apr. 12, 2005

(54) CONTAINER WITH COLLAPSIBLE SIDES

(75) Inventor: Erik Markvard Grubbe Nesting, Middelfart (DK)

(73) Assignee: Bekaert Handling Group A/S, Copenhagen K (DK)

( * ) Notice: Subject to any disclaimer, the term of this patent is extended or adjusted under 35 U.S.C. 154(b) by 3 days.

(21) Appl. No.: 10/311,649

(22) PCT Filed: Jun. 15, 2001

(86) PCT No.: PCT/DK01/00419

§ 371 (c)(1),
(2), (4) Date: Dec. 16, 2002

(87) PCT Pub. No.: WO01/96214

PCT Pub. Date: Dec. 20, 2001

(65) Prior Publication Data

US 2004/0026296 A1 Feb. 12, 2004

(30) Foreign Application Priority Data

Jun. 16, 2000 (EP) ..... 0610062

(51) Int. Cl.[7] ..... B65D 6/16
(52) U.S. Cl. ..... 220/7; 206/600
(58) Field of Search ..... 220/7, 1.5, 6, 4.28; 206/600

(56) References Cited

U.S. PATENT DOCUMENTS 1,602,783 A 10/1926 Sands
3,545,713 A * 12/1970 Hamilton et al. ..... 410/83
4,020,967 A * 5/1977 Hammond et al. ..... 220/6
4,240,359 A * 12/1980 Howe ..... 108/53.1
4,314,686 A 2/1982 Marz
4,715,508 A * 12/1987 Schurch ..... 220/7
5,056,667 A * 10/1991 Coogan ..... 206/600
5,261,550 A * 11/1993 Karpisek ..... 220/4.33
5,509,559 A * 4/1996 Okano et al. ..... 220/1.5
6,234,315 B1 5/2001 Karpisek

FOREIGN PATENT DOCUMENTS

| | | |
|---|---|---|
| EP | 0 411 722 | 2/1991 |
| FR | 2 259 019 | 8/1975 |
| WO | WO 92/02425 | 2/1992 |
| WO | WO 93/24379 | 12/1993 |
| WO | WO 99/26851 | 6/1999 |

* cited by examiner

*Primary Examiner*—Joseph C. Merek
(74) *Attorney, Agent, or Firm*—Merchant & Gould P.C.

(57) ABSTRACT

A container (1) with collapsible sides (3*a*,3*b*,3*c*,3*d*,5*a*,5*b*), wherein at least one side (3*a*) is provided with at least one pivotally mounted lock handle (12) with a lock pin (13) that can, while protruding from the side (3*a*), be introduced into an opening (14) in an abutting side (3*d*), wherein the lock pin (13) can, by turning of the lock handle (12), be caused to lockingly engage with the opening (14). The lock handle (12) is pivotally mounted in such a manner that in this locking position as well as in its resting position in which the lock pin does not engage with the opening (14) is situated substantially along the side (3*a*), while in other positions it protrudes considerably from the side (3*a*). The lock handle (12) is provided with a spring mechanism that will, irrespective of the position of the lock handle, influence it with a force in a direction towards its locking and resting positions.

9 Claims, 2 Drawing Sheets

CONTAINER WITH COLLAPSIBLE SIDES

Figure 1:
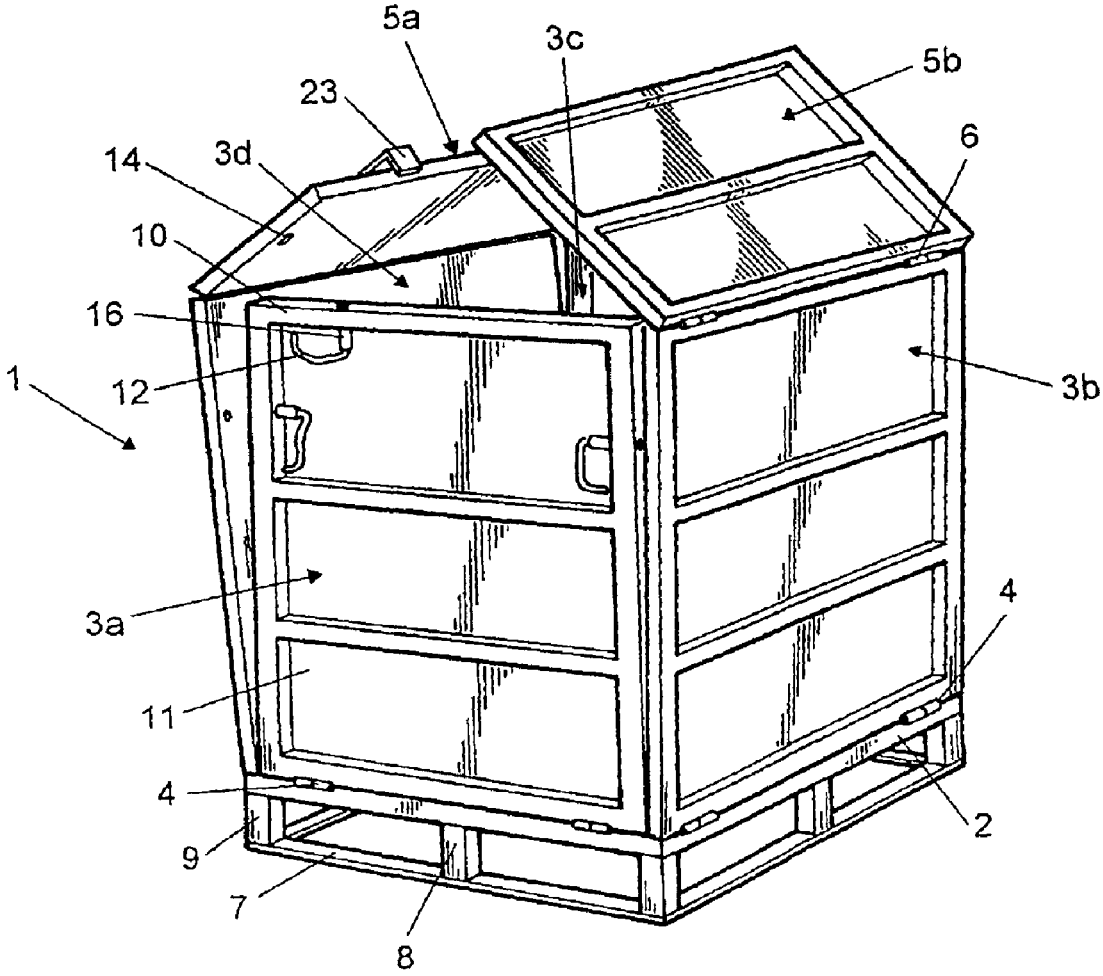

The invention relates to a container with collapsible sides, wherein at least one side is provided with at least one pivotally mounted lock handle with a lock pin that protrudes laterally and can be inserted into an opening in an abutting side, which lock pin can—upon turning of the lock handle—be caused to lockingly engage with said opening, wherein the lock handle is pivotally mounted in such a manner that in this locking position as well as in its resting position, in which the lock pin does not engage with the opening, it is positioned substantially along the side, whereas in other positions it protrudes considerably from the side.

Such container is known in the form of a so-called liquid container that consists of a container bottom and sides associated therewith that comprise lateral walls as well as a lid that is connected to the lateral walls and that is optionally divided into two. Besides, the container comprises an internal flexible bag in which the liquid is contained and which is supported by the container sides.

The container can be configured with lateral walls that are hinged to the container bottom whereas the lid or the lid parts are hinged to one or more lateral walls whereby the container is collapsible when empty. Alternatively the container can be configured with loose sides, the lateral walls as well as the lid or the lid parts being configured such that the container can be disassembled and the parts stacked when it is empty. Examples of such containers are disclosed in WO 92/02425, FR-A-2 259 019 and WO 99/26851.

In one of these prior art liquid containers the lateral walls and the lid or the lid elements comprise profile frames that are preferably composed of square profiles of galvanised steel, the side of the profile frames that faces inwards towards the flexible bag being provided with a plate element that thus constitutes the lateral face as such. Some of the lateral walls are provided with lock pins that are able to engage with openings provided in the abutting lateral walls or the lid elements. Via a rod element the lock pin is connected to a pivotally mounted lock handle, and the rod element extends out through the profile frame parallel with the plane of the lateral wall. When the lateral walls of the container are assembled with each other and when the lateral walls are assembled with the lid or the lid elements, the lock pin is shifted into an opening provided in the profile frame of the abutting side, and when the lock handle is turned the lock pin is turned whereby it is caused to lockingly engage with the opening. When the lock handle is in this locking position, it is positioned towards the side which means that no parts thereof extend beyond the outer dimensions of the container.

The lock handle is configured such that the lock pin can be withdrawn into the profile frame when it is not in engagement with an abutting side, and the lock handle is also in this resting position arranged along the side which means that it does not protrude there from.

The lock mechanism can be provided with a leaf spring that causes the lock handle to remain in this resting position in which it is positioned along the side. However, this functionality depends entirely on whether the operator manages to position the lock handle correctly, and if this is not the case there is a risk that the lock handle will occupy a position in which it protrudes from the side of the container with an ensuing high risk of puncturing other containers when they are manoeuvred closely to each other. Besides, there is also a risk that such protruding lock handle may seize other surrounding elements with a subsequent risk of causing destruction or damage.

This risk is particularly expressed for the lock handles that are positioned at the top part of a lateral wall and that are able to engage with the lid or the lid elements of the container. When these lock handles do not engage with the lid or the lid elements, they are kept along the side by the leaf spring only if the operator has carefully seen to it. Such lock handles turning about a vertical axis, the force of gravity does not contribute to keeping the lock handle in a position along the side, and therefore the lock handles will—if they are not correctly positioned—occupy positions in which they protrude from the side with the ensuing risks described above.

Besides, tests have shown that even in case a lock handle is arranged in the correct position in which the leaf spring keeps it in place, handling and vibrations may cause the lock handle to be shook loose and protrude from the side.

It is the object of the present invention to provide a container of the kind described above wherein the risk of a lock handle unintentionally protruding from the container sides is eliminated.

This is obtained by configuring the above-mentioned container such that the lock handle is provided with a spring mechanism comprising a torsionally biased spring that will, irrespective of the position of the lock handle, influence same with a force in the direction of its locking and resting position.

Hereby it is obtained that at any time the lock handle will occupy a position in which it is situated substantially along the side unless influenced manually by a force that causes it to protrude from the side, eg when the lock pin is to be introduced into the opening in the abutting side.

According to a preferred embodiment the container is of the type wherein each side is constructed from a profile frame with at least one sheet element mounted on the one side of the profile frame, the lock handle being in its locking position as well as its resting position substantially within the expanse of the profile frame perpendicular to the sheet element. In such container the lock handle in the locking and resting positions will be situated within the outer dimensions of the container thereby eliminating the risk of other elements or containers engaging with the lock handle.

Preferably the lock handle comprises a rod element that extends through a holder part that is mounted on the profile frame while the spring mechanism comprises a helical spring that is arranged around the rod element, the one end thereof being attached to the rod element and the other end being attached to the holder part. Hereby a very simple and operationally reliable configuration of the lock handle is accomplished.

Advantageously the holder part can be configured as a tubular member, the open end of which engages with the lock handle when in its locking position, the helical spring being arranged interiorly of the tubular member. In this manner the open end of the tubular element constitutes a simple abutment for the lock handle when caused to occupy the locking position, and simultaneously the spring mechanism is protected effectively against the environment.

Preferably the tubular member has a bevel-cut edge for the lock handle to engage with that permits the lock pin to be displaced further from the side compared to the situation when the lock handle is in its locking position. Displacement of the lock pin further from the side facilitates introduction of the lock pin into the opening of the abutting side.

In accordance with the preferred embodiment the outermost wall of the profile frame has an opening large enough for the locking pin to pass there through, and the helical spring is configured such that the locking pin is positioned immediately within the outermost wall of the profile frame when the helical spring is unbiased in its longitudinal direction. Due to this configuration the lock pin will be situated within the outer contour of the side when the lock handle is in its resting position in which the lock pin does not engage with an abutting side. Hereby it is accomplished, on the one hand, that there is no protruding lock pin that will accidentally engage with the surroundings and, on the other hand, that an abutting side can be caused to assume a correct interconnecting position without having to be diverted around a protruding locking pin.

Figure 2A:
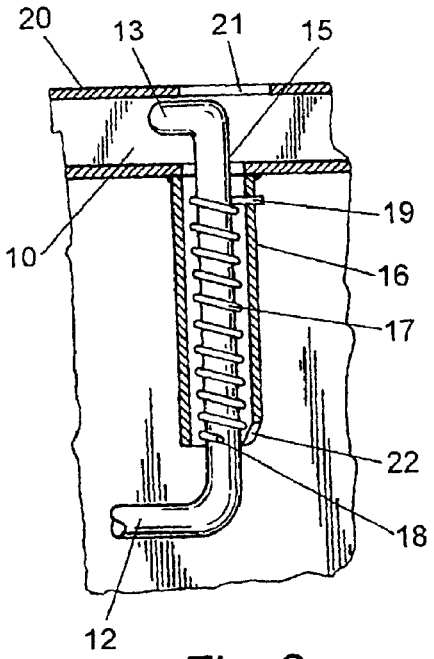
Figure 2B:
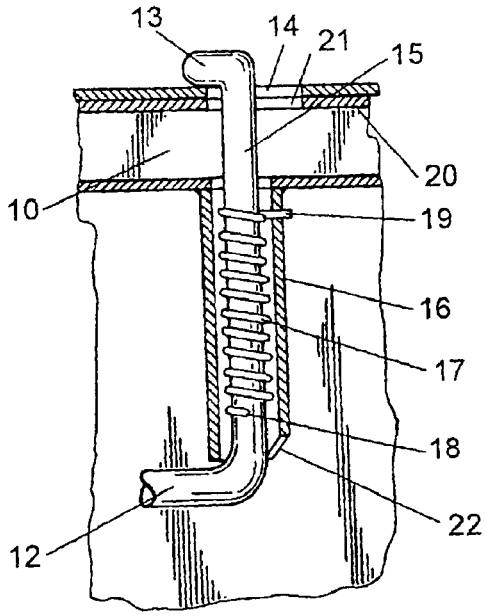
Figure 3A:
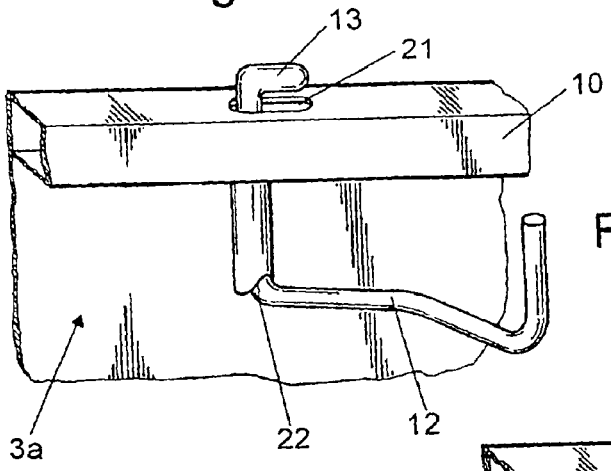
Figure 3B:
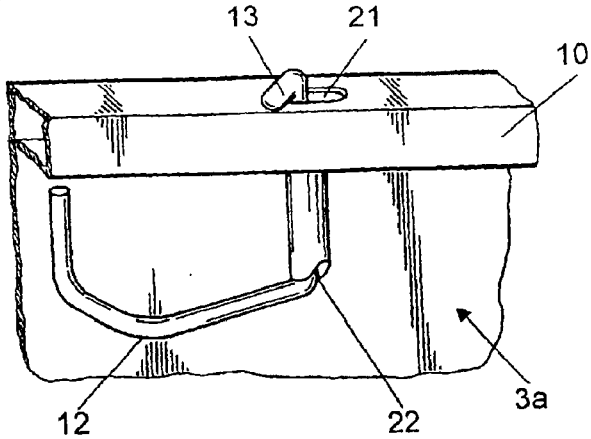

The invention will now be described in further detail with reference to the drawings, wherein FIG. 1 shows a container according to the invention;

FIGS. 2*a* and 2*b* are sectional views through a preferred embodiment of a locking mechanism used in a container according to the invention; and FIGS. 3*a* and 3*b* show two positions of a lock handle used in a container according to the invention.

FIG. 1 shows a container 1 according to the invention. The container 1 comprises a container bottom 2, four lateral walls 3*a*, 3*b*, 3*c*, 3*d* that are, in the embodiment shown, each hinged to the container bottom 2 by means of hinges 4, and two lid elements 5*a* and 5*b* that are connected to respective lateral walls 3*b* and 3*d* by hinges 6. The hinges 4 are preferably arranged at different heights relative to the container bottom 2, such that the lateral walls 3*a*–3*d* and the lid elements 5*a*, 5*b* can be folded down on top of each other when the container 1 is empty. However, this is not a feature of the present invention and will not be described in detail herein.

The container bottom 2 is provided with runners 7 that are arranged at a certain distance from the bottom as such of the container 1 by means of spacers 8 and corner elements 9. Thus a space is formed between the runners 7 and the bottom of the container 1 thereby enabling the container 1 to be handled by means of a forklift.

It will appear that all of the lateral walls 3*a*–3*d* have a slight outwards inclination when not interconnected. However they can all be raised to vertical position, following which they can be interconnected by means of locking mechanisms as will be described below. Likewise, the two lid portions 5*a*, 5*b* are partially open, but they can also be caused to abut on the upper edge of the lateral walls 3*a*–3*d* and to be interconnected therewith by means of locking mechanisms.

In this description the term "side" is used to designate both the lateral walls 3*a*–3*d* and the two lid portions 5*a*, 5*b* since they are in principle constructed in the same manner, and since the locking mechanisms for interconnection thereof are identical. When two abutting sides are thus interconnected, it covers both interconnection of two lateral walls 3*a*–3*d* and of a lateral wall 3*a*–3*d* and a lid portion 5*a*, 5*b*.

Each side 3*a*–3*d*, 5*a*, 5*b* comprises a profile frame 10 that is preferably constructed from square profiles of galvanised steel, wherein the side of the profile frames that faces inwards is provided with a sheet element 11 that thus constitutes the lateral face as such. Each side 3*a*–3*d*, 5*a*, 5*b* thus has a smooth inner face whereas the outer face is provided with indentations corresponding to the openings of the profile frame 10.

The lateral wall 3*a* is provided with three identical lock handles 12, one to each side and one at the upper profile frame 10, and the opposite lateral wall 3*c* is provided with corresponding lock handles 12. The description that follows takes its starting point in the lock handle 12 arranged at the upper profile frame 10 on the lateral wall 3*a*, the construction and functionality of the remaining lock handles being completely identical.

The lock handle 12 is mounted to be pivotal relative to the lateral wall 3*a* and can be shifted out of the lateral wall 3*a* and with a lock pin 13 (cf FIGS. 2*a*–2*b*) enter into engagement with an opening 14 in the lid portion 5*a*. The lock handle 12 is shown in enlarged scale in FIGS. 2*a* and 2*b* and in FIGS. 3*a* and 3*b*, FIGS. 2*a* and 2*b* being cross sectional views of the lock handle 12 in two different positions, while FIGS. 3*a* and 3*b* show the lock handle 12 in two other positions.

The lock handle 12 comprises a rod element 15 that extends through a holder part in the form of a tubular member 16 that is mounted on the profile frame 10, eg by welding as shown in FIGS. 2*a* and 2*b*, and further on into the profile frame 10. At the end of the rod element 15 a lock pin 13 is provided that is able to engage with an opening 14 provided in the abutting lid portion 5*a*. A corresponding opening 14 is provided at the opposite side of the lid portion 5*a* and, besides, also in the lateral walls 3*b* and 3*d* for cooperation with the remaining lock handles 12 with lock pins 13 provided in the lateral walls 3*a* and 3*c*.

A helical spring 17 is arranged around the rod element 15 and within the tubular element 16. The one end of the helical spring 17 is provided with a first holding pin 18 that extends into an opening in the rod element 15 and in this manner it is secured therein. The other end of the helical spring 17 is provided with a second holding pin 19 that extends out of an opening in the tubular member 16 and it is in this manner secured therein. Thus, the helical spring 17 is biased between the rod element 15 and the tubular member 16 and thus thereby between the lock handle 12 and the lateral wall 3*a*.

FIGS. 1 and 2*a* show the lock handle 12 in its resting position where it is not in engagement with an abutting side. The helical spring 17 is torsionally biased such that the lock handle 12 maintains this position when not influenced by an outer force, since it influences the lock handle by a force in a direction towards this resting position. In this position the lock handle 12 is situtated within the indentations of the lateral wall 3*a* that are formed by the profile frame 10 and the plate element 11. Thus no parts of the lock handle 12 protrudes beyond the outer dimensions of the container 1, and the risk of the lock handles 12 being the cause of accidents or damage, if any, is eliminated.

In its resting position the helical spring 17 occupies substantially the position in which it is unloaded in its longitudinal direction. It will appear from FIG. 2*a* that the lock pin 13 is in a position immediately within the outermost wall 20 of the profile frame 10 that is provided with an oblong opening 21 of a size sufficient for the lock pin 13 to pass there through, but not until the lock handle 12 has been turned away from its resting position.

Once the lock handle 12 is in its resting position there are thus no parts of the locking mechanism that protrudes beyond the outer dimensions of the container 1, the helical spring 17 serving to ensure that the lock handle 12 is positioned along the lateral wall 3a while simultaneously the lock pin 13 is positioned within the outermost wall 20 of the profile frame 10.

When the lateral wall 3a is to be coupled to the lid portion 5*a* the opening 14 of the lid portion 5*a* is caused to abut on the opening 21 of the profile frame 10. The lock handle 12 is turned against the spring force away from the lateral wall 3a and is subsequently pushed through the opening 21 of the profile frame 8 and into the opening 14 in the lid portion.

The lock handle 12 is then turned towards the lateral wall 3 again, and the lock pin 13 engages behind the opening 14 in the abutting lateral wall 3*d*. This position is shown in FIG. 2*b*and it will appear how the helical spring 17 is in this case compressed in its longitudinal direction. Thus, the helical spring 17 has in this locking position a double function, viz also in this case to seek to turn the lock handle 12 towards the lateral wall 3*a*, and also to contribute with a force that pulls the lid portion 5*a* towards the lateral wall 3*a*. However, it should be mentioned that the friction between the lock pin 13 and the lid portion 5*a* in the locking position is in practice of a considerable magnitude, and that the contribution of the helical spring 17 to securing the lid part 5*a* is of minor significance only. However, transport of the container 1 can entail vibrations and shakings that may influence the clamping force, and in that event the helical spring 17 contributes to keeping the lock handle 12 in the locking position.

It will appear from FIGS. 2*a* and 2*b* that the tubular member 12 is provided with a bevel-cut edge 22 at its open end. This bevel-cut edge 22 permits the lock handle 12 to be displaced slightly further upwards compared to the teachings of FIG. 2*b* when the lock handle 12 is pivoted to the right. This is shown in FIG. 3*a* wherein the lock handle 12 is shown in the position where the lock pin 13 is introduced into the opening 14 in the lid portion 5*a*. It will appear how that part of the lock handle 12 that is situated in immediate extension of the rod element 15 and that is bent to form a right angle is in engagement with the bevel-cut edge 22. Hereby the lock pin 13 is caused to protrude further out of the profile frame 10, which makes it easier to insert it sufficiently far into the opening 14 when the lateral wall 3*a* is coupled to the lid portion 5*a*.

The presence of the bevel-cut edge 22 also means that a tight clamping of the lateral wall 3a and the lid portion 5*a* can be accomplished, the bevel-cut edge 22 causing the lock handle 12 to be forced downwards in FIG. 3*a* when it is turned to the left in order to reach the locking position as shown in FIG. 3*b* and that corresponds to FIG. 2*b*. This tight clamping contributes with a substantial frictional force to securing the lock handle 12 in the locking position.

In the shown embodiment of a container 1 according to the invention one lock handle 12 is provided in each side for securing the lid portion 5*a*. However, a corresponding lock handle 12 is not provided for securing the lid portion 5*b*, this lid portion 5*b* being secured by one or more lock hooks 23 (cf FIG. 1) that protrudes from the lock 30 portion 5*a*. This means that the lid of the container 1 is closed by initially closing the lid portion 5*b*, following which the lid portion 5*b* is closed whereby the lock hook 23 is caused to seize around the profile frame of the lock portion 5*a*. The lock handle 12 is subsequently turned outwards, the lock pin 13 is introduced into the opening 14 of the lock portion 5*a*, and the lock handle 12 is reverted to the locking position. In this manner the lid portion 5*a* as well as the lid portion 5*b* are secured.

The invention has been described with reference to a preferred embodiment that is shown in the drawings and with particular reference to interconnection between the lateral wall 3*a* and the lid portion 5*a*. As mentioned previously the problem of protruding lock handles in the known containers is particularly expressed in the lock handles that are configured for interconnecting the lateral walls with the lid or the lid portions. The lock handles for mutually interconnecting the lateral walls will, if oriented as shown in FIG. 1, be kept in this position partly by gravity, but they must also advantageously be configured with a spring mechanism as described.

It is possible to carry out a number of variations compared to the embodiment shown. Thus, the lock handle as claimed can be configured differently from what is shown in the description while having the same functionality, and also the number of lock handles on the container can be varied in accordance with the relevant need. The lateral walls and lid of the container can also be configured in other ways than shown.

What is claimed is:

1. A container with collapsible sides, wherein at least one side is provided with at least one pivotially mounted lock handle with a lock pin;

said lock pin is arranged to be introduced into an opening in an abutting side, wherein the lock pin protrudes from a side, and said lock pin is in a locking position when the lock pin lockingly engages with the opening by turning the lock handle, said lock handle being pivotally mounted in such manner that in the locking position as well as in a resting position the lock handle is situated substantially along side while in other positions it protrudes considerably from the side, wherein when the lock handle is in the resting position the lock pin does not engage with the opening, said lock handle being provided with a spring mechanism comprising a torsionally biased spring that will, irrespective of the position of the lock handle, influence the lock handle with a force in a direction towards the lock handle locking and resting positions.

2. A container according to claim 1, wherein each side is constructed of a profile frame with at least one sheet element mounted on one side of the profile frame and wherein the lock handle in its locking position as well as in its resting position is situated substantially within the expanse of the profile frame perpendicular to the sheet element.

3. A container according to claim 1, wherein the lock handle comprises a rod element that extends through a holder part mounted on a profile frame; and wherein the spring mechanism comprises a helical spring configured around the rod element, wherein an end of the helical spring is attached to the rod element and wherein another end of the helical spring is attached to the holder part.

4. A container according to claim 3, wherein the holder part is configured as a tubular member with an open end that engages the lock handle when the lock handle is in the locking position; and the helical spring is arranged interiorly of the tubular member.

5. A container according to claim 4, wherein the tubular member has a bevel-cut edge with which the lock handle is able to engage and that permits the lock pin to be displaced further from the side compared to the situation when the lock handle is in its locking position.

6. A container according to claim 3, wherein an outer wall of the profile frame has an opening large enough to allow the lock pin to pass there through; and wherein the helical spring is configured such that the lock pin is positioned immediately within the outer wall of the profile frame when the helical spring is unloaded in its longitudinal direction.

7. A container according to claim 2, wherein the lock handle comprises a rod element that extends through a holder part mounted on the profile frame; and wherein the spring mechanism comprises a helical spring configured around the rod element, wherein an end of the helical spring is attached to the rod element and wherein another end of the helical spring is attached to the holder part.

8. A container according to claim 4, wherein an outer wall of the profile frame has an opening large enough to allow the lock pin to pass there through; and wherein the helical spring is configured such that the lock pin is positioned immediately within the outer wall of the profile frame when the helical spring is unloaded in its longitudinal direction.

9. A container according to claim 5, wherein an outer wall of the profile frame has an opening large enough allow the lock pin to pass there through; and wherein the helical spring is configured such that the lock pin is positioned immediately within the outer wall of the profile frame when the helical spring is unloaded in its longitudinal direction.

* * * * *